US005181282A

United States Patent [19]

Comparetti

[11] Patent Number: 5,181,282

[45] Date of Patent: Jan. 26, 1993

[54] SEMI-FLUSH FLAPPER VALVE

[76] Inventor: Joseph Comparetti, 23 Cedar Grove Ave., Lake Grove, N.Y. 11755

[21] Appl. No.: 788,561

[22] Filed: Nov. 6, 1991

[51] Int. Cl.[5] ..... E03D 1/35

[52] U.S. Cl. ..... 4/404; 4/393; 4/325

[58] Field of Search ..... 4/324, 325, 378, 392, 4/393, 395, 404, 403, 415, 379, 381, 382, 387

[56] References Cited

U.S. PATENT DOCUMENTS 3,964,109 6/1976 Street et al. ..... 4/393 X
4,910,812 3/1990 Comperetti ..... 4/325
4,937,894 7/1990 Hill, Jr. et al. ..... 4/404 X
4,969,218 11/1990 Comparetti ..... 4/325

*Primary Examiner*—Charles E. Phillips
*Attorney, Agent, or Firm*—Richard L. Miller

[57] ABSTRACT

A semi-flush flapper valve apparatus is provided for use in a toilet and consists of a two position operable flush handle on the toilet tank. A main flapper valve has a bleeder valve pivotally mounted thereto. The operating handle is rotated in a first direction to operate the main flapper valve normally thereby causing a conventional full flush cycle in the toilet tank. The operating handle is rotated in a second direction to open the bleeder valve and operate the main flapper valve together thereby venting air from the main flapper valve so as to make the main flapper valve close faster causing a semi-flush cycle in the toilet tank.

5 Claims, 2 Drawing Sheets

SEMI-FLUSH FLAPPER VALVE

BACKGROUND OF THE INVENTION

The instant invention relates generally to toilet flush valve systems and more specifically it relates to a semi-flush flapper valve apparatus.

Numerous toilet flush valve systems have been provided in the prior art that are adapted to regulate the volume of water discharged for flushing when evacuating toilet bowls. For example, U.S. Pat. Nos. 3,325,828 to Alexander; 4,483,024 to Trosh; 4,502,984 to Burns 4,620,331 to Saguelo and 4,910,912 & 4,969,218 to Comparetti all are illustrative of such prior art. While these units may be suitable for the particular purpose to which they address, they would not be as suitable for the purpose of the present invention as hereafter described.

SUMMARY OF THE INVENTION

A primary object of the present invention is to provide a semi-flush flapper valve apparatus that will overcome the shortcomings of the prior art devices.

Another object is to provide a semi-flush flapper valve apparatus that includes an operating handle rotatively mounted to the toilet tank such that said operating handle can rotate in a first direction to cause a full conventional flush and in a second direction to cause the tank to empty only partially.

An additional object is to provide a semi-flush valve apparatus that is simple to install as a replacement for a more conventional device and yet easy to use.

A still further object is to provide a semi-flush flapper valve apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
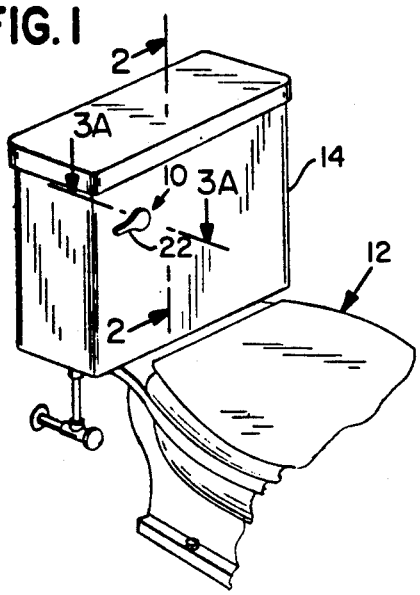
FIG. 1 is a diagrammatic perspective view with parts broken away of a toilet having the instant invention installed thereon.
Figure 2:
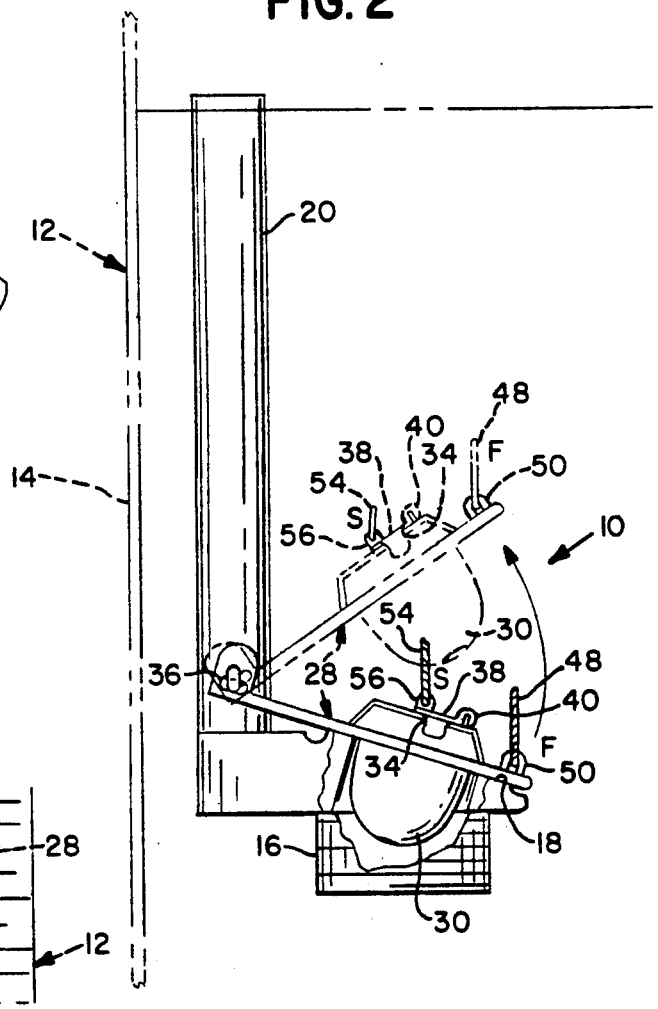
FIG. 2 is a diagrammatic cross sectional view with parts broken away taken on line 2—2 of FIG. 1.
Figure 4:
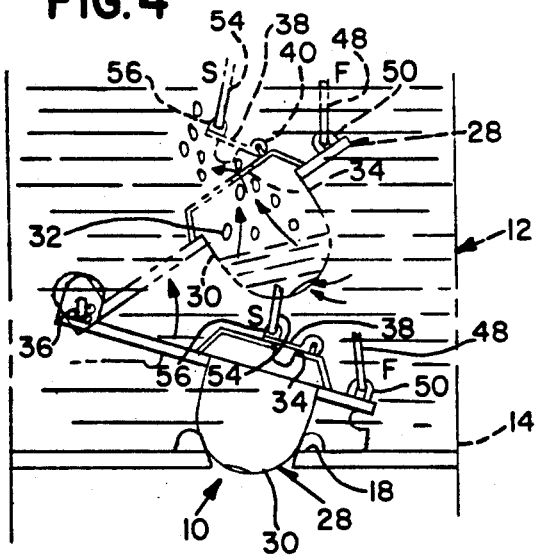
FIG. 4 is a diagrammatic cross sectional view with parts broken away also taken on line 2—2 of FIG. 1, illustrating a partial flush taking place.
Figure 3A:
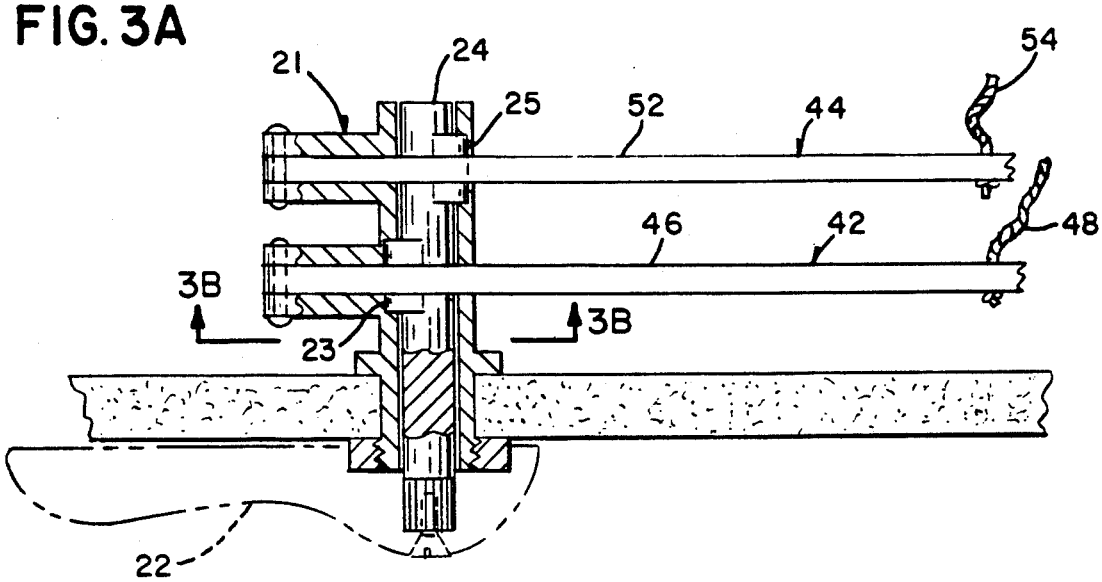
FIG. 3A is a diagrammatic cross sectional view with parts broken away taken on line 3A—3A of FIG. 1.
Figure 3B:
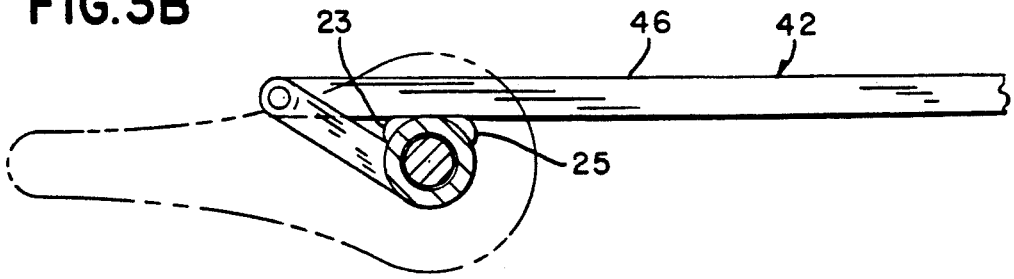
FIG. 3B is a cross sectional view taken on line 3B—3B in FIG. 3A with the outline of operating handle shown in phantom for clarity.
Figure 3C:
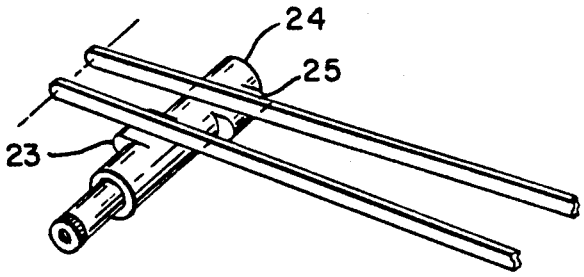
FIG. 3C is a diagrammatic perspective view illustrating the cooperative relationship between the shaft and alternately operable lift arms.

Turning now descriptively to the drawings, in which similar reference characters denote similar elements throughout the several views, the figures illustrate a semi-flush flapper valve apparatus 10 for use in a toilet 12 of the type having a tank 14, a flush port 16, a valve seat 18 and an overflow tube 20. The apparatus 10 consists of an operating handle 22 rotatively mounted to the toilet tank so that the operating handle can rotate in a first direction and in a second direction. The operating handle 22 is secured to the shaft 24 by means of a set screw. The shaft 24 is constructed having two cams, each of which will alternately operate one of the two lift arms respectively as the shaft is rotated in a first direction or in a second direction. A main flapper valve 28 has a chamber 30 for holding air 32 therein and a top air release hole 34. The main flapper valve 28 is pivotally mounted at one end 36 to the overflow tube 20, so as to normally sit upon the valve seat 18 over the flush port 16. A bleeder valve 38 is oppositely pivotally mounted at one end 40 onto the main flapper valve 28 to normally cover the top air release hole 34. When the bleeder valve 38 is opened, it will release the air 32 from the chamber 30 in the main flapper valve 28. A first mechanism 42 is coupled between the operating handle 22 and the main flapper valve 28, for causing a conventional full flush cycle in the toilet tank 14, when the operating handle 22 is rotated in a first direction on the toilet tank 14, so as to normally open and close the main flapper valve 28 on the valve seat 18. A second mechanism 44 is coupled between the operating handle 22 and the bleeder valve 38, for causing a semi-flush cycle in the toilet tank 14. When the operating handle 24 is rotated in a second direction on the toilet tank 14, it causes to open the bleeder valve 38 and simultaneously pulls up the main flapper valve 28, allowing the main flapper valve 28 to close faster onto the valve seat 28 because air is vented out of the bleeder valve 38 as previously indicated.

The first mechanism 42 includes a first lift arm 46 pivotally mounted to shaft housing 21 and resting in close proximity to the first cam 23 on shaft 24. This first lift arm 46 will be pushed upward by the cam 23 when the operating handle 22 is rotated in a first direction. A first flexible lanyard 48 is connected between an end of the first lift arm 46 and a loop 50 on the main flapper valve 28 oppositely from the pivotally mounted end 36 thereof.

The second mechanism 44 includes a second lift arm 52 also pivotally mounted to the shaft housing 21 and resting in close proximity to the second cam 25 on the shaft 24. This second lift arm 52 will be pushed upward by the second cam 25 when the operating handle 22 is rotated in a second direction. A second flexible lanyard 54 is connected between an end of the second lift arm 52 and a loop 56 on the bleeder valve 38 oppositely from the pivotally mounted end 48 thereof. The main flapper valve 28 and the bleeder valve 38 are both fabricated out of flexible durable waterproof material, such as rubber or soft plastic.

The size of the top air release hole 34 will determine how soon the main flapper valve 28 will return to the valve seat 18 and hence the amount of water that flushes through the toilet 12. The bleeder valve 38 is fitted to the main flapper valve 28 in such a way that when the tank 14 is full the water pressure will press the main flapper valve 28 to seat firmly. When the first flexible lanyard 48 is pulled for a full flush the bleeder valve 38 will remain closed so that the full flash is achieved.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A semi-flush flapper valve apparatus for use in a toilet of the type having a tank, a flush port, a valve seat and an overflow tube, said apparatus comprising:

a) an operating handle rotatively mounted to the toilet tank, so that the operating handle can rotate both in a first direction and in a second direction;

b) a main flapper valve having a bottom chamber for trapping air therein and a top air release hole, said main flapper valve is pivotally mounted at one end to the overflow tube, so as to normally sit upon the valve seat over the flush port with said bottom chamber communicating with said flush port;

c) a bleeder valve which is pivotally mounted at one end onto said main flapper valve to normally cover the top air release hole;

d) a first means, coupled between said operating handle and said main flapper valve, for causing a conventional full flush cycle in the toilet tank, when said operating handle is rotated in a first direction on the toilet tank, so as to pivot said main flapper valve about said one end while said bleeder valve remains closed over said air release hole;

e) a second means, coupled between said operating handle and another end of said bleeder valve, for causing a semi-flush cycle in the toilet tank, when said operating handle is rotated in a second direction on the toilet tank, whereby said bleeder valve will pivot about said pivotal mounting to open said air bleeder hole and pull up said main flapper valve, allowing said main flapper valve to subsequently close faster than normal onto the valve seat due to lack of buoyancy thereof.

2. A semi-flush flapper valve apparatus as recited in claim 1, wherein said first means includes:

a) a first lift arm coupled to said operating handle, so that said first lift arm will be lifted when said operating handle is rotated in a first direction; and b) a first flexible lanyard connected between an end of said first lift arm and a loop on said main flapper valve oppositely from the pivotally mounted end thereof.

3. A semi-flush flapper valve apparatus as recited in claim 2, wherein said second means includes:

a) a second arm lift coupled to said operating handle, so that said second lift arm will be lifted when said operating handle is rotated in a second direction; and b) a second flexible lanyard connected between an end of said second lift arm and a loop on said bleeder valve oppositely from the pivotally mounted end thereof.

4. A semi-flush flapper valve apparatus as recited in claim 3, wherein said main flapper valve and said bleeder valve are both fabricated out of flexible durable waterproof material.

5. A semi-flush flapper valve apparatus as recited in claim 1, further comprising:

a) a shaft fixedly secured to said operating handle and having a first cam and second cam integrally formed thereon and which rotate when said operating handle is rotated;

b) a first lift arm which is pivotally mounted to said housing which is caused to be raised by contact with said first cam only when said operating handle is rotated in said first direction;

c) a second lift arm which is pivotally mounted to said housing which is caused to be raised by contact with said second cam only when said operating handle is rotated in said second direction.

* * * * *